United States Patent [19]

Esformes

[11] Patent Number: 4,787,442

[45] Date of Patent: Nov. 29, 1988

[54] DELTA WING AND RAMP WING ENHANCED PLATE FIN

[75] Inventor: Jack L. Esformes, North Syracuse, N.Y.

[73] Assignee: Carrier Corporation, Syracuse, N.Y.

[21] Appl. No.: 128,962

[22] Filed: Dec. 4, 1987

[51] Int. Cl.[4] ..... B22C 19/04

[52] U.S. Cl. ..... 165/151; 165/181

[58] Field of Search ..... 165/151, 181, 182

[56] References Cited

U.S. PATENT DOCUMENTS 1,416,570 5/1922 Modine ..... 165/151

FOREIGN PATENT DOCUMENTS 5575190 6/1980 Japan ..... 165/151

*Primary Examiner*—Samuel Scott

*Assistant Examiner*—Noah Kamen

*Attorney, Agent, or Firm*—Robert H. Kelly

[57] ABSTRACT

A sine-wave like plate fin for a finned tube heat exchanger coil is provided having an improved enhanced heat transfer area between adjacent pairs of holes in the plate fin. The enhanced heat transfer area includes a plurality of rows of triangular delta wings and ramp wings which generate counter rotating vortices to promote restarting or thinning of the hydrodynamic boundary layer and mixing the bulk fluid.

4 Claims, 1 Drawing Sheet

DELTA WING AND RAMP WING ENHANCED PLATE FIN

BACKGROUND OF THE INVENTION

The present invention relates generally to heat exchangers, and more particularly to finned tube heat exchanger coils having sine-wave like plate fins including delta wing and ramp wing enhancements for generating counter rotating vortices for both bulk fluid mixing and boundary layer scrubbing.

Plate fins utilized in the air conditioning and refrigeration industry are normally manufactured by progressively stamping a coil of flat plate fin stock and then cutting the stamped fin to the desired length. The fins are then collected in the proper orientation and number in preparation for forming a coil. Previously formed hairpin tubes are then inserted through openings within the fins and thereafter expanded to form mechanical and thermal connections between the tubes and fins. The open ends of the hairpin tubes are fluidly connected by way of U-shaped return bends, and subsequently the return bends are soldered or brazed in place.

The plate fins are typically manufactured in a plurality of dies to form the fin shape, as well as surface enhancements on the fin, and openings through which hair pin or straight tubular members are inserted.

Generally, the HVAC industry presently forms a plurality of rows of fins simultaneously from a single roll of flat plate fin stock. These multi-row fins are cut to the desired number of rows for the coils and are then collected on stacking rods or within a box or some other means to form a pile or stack of fins ready to be laced with hairpin tubes or the like to form the coil.

It is known that a fundamental contributor to the limiting of local convective heat transfer is the establishment and persistence of a thick hydrodynamic boundary layer on the plate fin surfaces of heat exchangers. For this reason, prior art fins are provided with a variety of surface variations or enhancements, for example, lances or louvers, to restart or disrupt the boundary layer and, thus increase the transfer of heat energy between the fluid passing through the tubular members and the fluid passing over the plate fin surfaces. These prior art enhanced fins are generally either enhanced flat fins or convoluted fins. Flat fins are generally enhanced by manufacturing raised lances therein. A raised lance is defined as an elongated portion of fin formed by two parallel slits whereby the stock between the parallel slits is raised from the surface of the fin stock. In addition to having raised lances, enhanced fins may also have louvered enhancements. A louver is defined as a section of fin stock having one or two elongated slits wherein the portion of fin stock moved from the surface of the fin stock always has at least one point remaining on the surface of the fin stock. These lances and louvers promote restarting or thinning of the hydrodynamic boundary layer, thus increasing the local heat transfer coefficient. However, generally large numbers of lances and louvers are added to a surface to improve the heat transfer. These enhancements are always accompanied by an increase in pressure drop through the coil. Further, such lanced and louvered plate fins may be difficult and costly to manufacture.

Thus, there is a clear need for a sine-wave like plate fin having a combination of alternating delta wing and ramp wing enhanced surface which results in a more favorable balance of heat transfer enhancement to fluid pressure loss by providing both bulk core fluid mixing and direct boundary layer scrubbing or mixing.

SUMMARY OF THE INVENTION

It is an object of the present invention to decrease the fluid film thermal resistance of a plate fin while not unduly increasing the pressure drop, thus improving the transfer of heat from an enhanced fin in a plate fin heat exchanger coil.

It is another object of the present invention to provide an enhanced plate fin having a sine-wave like pattern in cross-section with both delta wing and ramp wing enhancements at or downstream of the peaks of the sine-wave to promote mixing of the core bulk fluid and scrubbing of the boundary layer fluid.

It is yet another object of the present invention to provide a gain in thermal performance in a plate fin by generating counter-rotating vortex pairs off ramp wings for bulk fluid mixing and generating vortex pairs from delta wings for direct flow into the boundary layer.

It is a further object of the present invention to provide an enhanced wavy fin with adjacent delta wings and ramp wings in a row which are alternately ramped up and down in adjacent rows.

These and other objects of the present invention are obtained by means of an enhanced plate fin having a sine-wave like pattern in cross-section having rows of adjacent delta wings and ramp wings generally at or downstream of the peaks of the sine-wave perpendicular to the flow across the plate fin. The adjacent rows of delta wings and ramp wings are in alternating patterns of pushed up and pushed down wings to achieve both bulk fluid mixing and direct boundary layer mixing on both sides of the plate fin.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification and which reference numerals shown in the drawings designate like or corresponding parts throughout the same, and in which.

DESCRIPTION OF THE PREFERRED EMBODIMENT

The embodiments of the invention described herein are adapted for use in condensing or evaporating heat exchangers used in heating, ventilating, and air conditioning systems, although it is to be understood that the invention finds like applicability in other forms of heat exchangers. Plate fin heat exchangers are generally used in conventional direct expansion vapor compression refrigeration systems. In such a system, the compressor compresses gaseous refrigerant, often R-22, which is then circulated through a condenser where is is cooled and liquified and then through an expanding control device to the low pressure side of the system where it is evaporated in another heat exchanger as it absorbs heat from the fluid to be cooled and changes phase from a partial liquid and partial vapor to a superheated vapor. The superheated vapor then flows the compressor to complete the cycle.

Typically, a plate fin heat exchanger is assembled by stacking a plurality of parallel fins, and inserting a plurality of hair pin tubes through the fins and mechanically expanding the tubes to make physical contact with each fin. The heat transfer characteristics of the heat exchanger are largely determined by the heat transfer characteristics of the individual plate fins.

Figure 1:
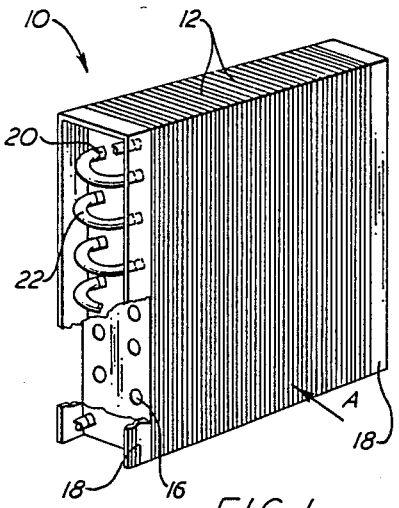
FIG. 1 is a perspective view of a plate fin heat exchanger incorporating the enhanced plate fin of the present invention.

Referring now to the drawings, FIG. 1 illustrates a fin tube heat exchanger coil 10 incorporating a preferred embodiment of the present invention. Heat exchanger coil 10 comprises a plurality of spaced-apart fin plates 12, wherein each plate fin 12 has a plurality of holes 16 therein. Fin plates 12 may be any heat conductive material, e.g. aluminum. Fin plates 12 are maintained together by oppositely disposed tube sheets 18 having holes therethrough (not shown) in axial alignment with holes 16. A plurality of hair pin tubes 20 are laced through selected pairs of holes 16 as illustrated and have their open ends joined together in fluid communication by return bends 22, which are secured to hair pin tubes 20 by soldering or brazing or the like. The hair pin tubes may be any heat conductive material, for example, copper.

In operation, a first fluid to be cooled or heated flows through hair pin tubes 20 and a cooling or heating fluid is then passed between fin sheets 12 and over tubes 20 in a direction indicated by arrow A. Heat energy is transferred from or to the first fluid through hair pin tubes 20 and plate fins 12 to or from the other fluid. The fluids may be different types, for example, the fluid flowing through tubes 20 can be refrigerant and the fluid flowing between plate fins 12 and over the tubes can be air.

As illustrated in FIG. 1, finned tube heat exchanger coil 10 is a staggered two-row coil since each plate fin 12 has two rows of staggered holes therein for receiving hair pin tubes 20. The present invention contemplates a heat exchanger coil of one or more rows of tubes, and with holes 16 of one row in either staggered or in-line relation with the holes 16 of an adjacent row. Also, the heat exchanger can be a composite heat exchanger made from a plurality of single row heat exchangers.

Figure 2:
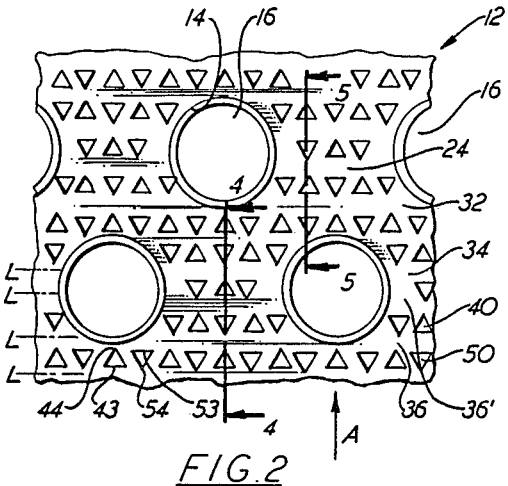
FIG. 2 is a top plan view of a multi-row plate fin according to a preferred embodiment of the present invention.
Figure 3:
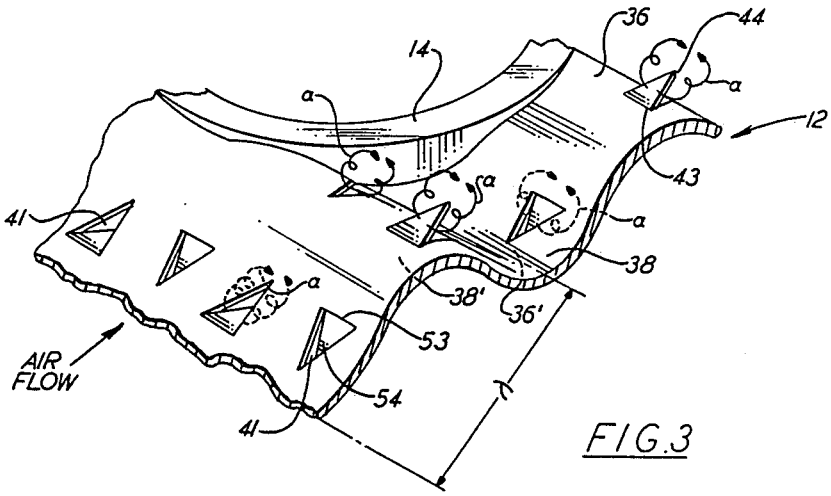
FIG. 3 is an enlarged partially broken away perspective view of the multi-row plate fin of FIG. 2.

Referring now to FIGS. 2–3, a portion of a multi-row plate fin is illustrated having staggered rows of tube holes 16 with enhanced heat transfer sections 24 between respective adjacent pairs of holes 16. A fluid, in the direction of arrow A, flows across the multi-row plate fin. Collars 14 are formed about holes 16 during fin manufacture for receiving tubes 20 therein and for properly spacing adjacent plate fins. In FIGS. 2–3, only the plate fin 12 is shown and the tubes that would normally pass through the collars 14 are omitted for simplicity.

In FIG. 2, the plate fin 12 has a fluid flowing over the top side or upper surface 32 and over the bottom side or lower surface 34. The fluid flows over both of these surfaces in the same direction. The ramp wings 40 and delta wings 50 are formed in rows along the plate fin 12 in a direction perpendicular to the flow A. The rows of delta wings and ramp wings are generally located at or downstream of the peaks 36, 36' of the upper surface 32 and lower surface 34 respectively. The peaks 36, 36' are defined as the maximum height on the respective surfaces 32, 34. One complete length of the sine-wave like pattern is defined as Lambda (λ), thus the rows of delta wings 50 and ramp wings 40 would be positioned between zero (0) Lambda and one-quarter Lambda downstream of peak 36, 36' on the upper surface 32 and lower surface 34 respectively.

A ramp wing 40 is defined as an enhancement having a base 43, which is attached to the upper 32 or lower 34 surface, upstream of a detached point 44. Further, a delta wing 50 is defined as an enhancement having a detached point 54, which is detached from the upper 32 or lower 34 surface, upstream of an attached base 53.

The adjacent wings in a single row are alternating delta wings 50 and ramp wings 40. Further, adjacent rows of wings are alternately moved up from the upper and lower surfaces 32, 34 respectively. Thus, the wings 40 are always moved in an upward direction, downstream of the peak on either upper 32 or lower 34 surface.

The ramp wings 40 and delta wings 50 in a single row are staggered with respect to each other and generate counter rotating vortices as shown by arrows a. The right hand vortice (in the direction of flow) rotates clockwise and the left vortice rotates counterclockwise. The adjacent rows of ramp and delta wings are further alternately bent up above the upper surface or down below the lower surface, as more clearly shown in FIG. 3 to increase the bulk mixing of the fluid between adjacent plate fins by ramp wings and to direct the vortices of the delta wings directly into the boundary layer to achieve boundary layer scrubbing. Still further, the ramp wings 40 and delta wings 50 are generally punched through the plate fin downstream of the center-line (shown as line L) of the peaks 36 and 36' on the upper or lower surfaces respectively, thus leaving an aperture 41 in the plate fin 12. The apertures 41, particularly with ramp wings, allow partial purging of the stagnant or recirculation region next to the surfaces of the plate fin at the troughs 38, 38' on the upper and lower surfaces respectively. The purging of the recirculation region is the result of a positive pressure difference across the aperture which is established by inertial forces associated with curvature of the flow path. The off-center position of the ramp wings 40 and delta wings 50 downstream of the center line (L) of the peaks 36 and 36' is generally equal to the point of maximum pressure difference. The ramp wings 40 and delta wings 50, shown as triangular shapes with their base portions 43, 53 attached to the fin surface 32, 34—although other suitable vortex generating shapes may be used—generate vortices (a) which travel downstream and energize the stalled boundary layer in the downstream troughs 38, 38' on both the upper 32 and lower 34 surfaces and provide bulk mixing of the fluid.

The uses of the ramp wings 40 and delta wings 50 in conjunction with the apertures 41 minimizes the reduction in conductive efficiency relative to lanced or louvered enhanced surfaces while preserving full heat transfer surface area.

In prior art wavy plate fin heat exchangers, flow channels were formed between two adjacent plate fins. The fluid passing between adjacent plate fins in the channels forms a boundary layer along the top and bottom surfaces of the plate fin. However, the air boundary layer separates downstream of the peaks of the upper surface and lower surface and recirculates or forms eddies in the next adjacent downstream trough.

An adverse pressure gradient is responsible for the formation of the eddies. The adverse pressure gradient is caused by streamline divergence and subsequent deceleration of the length-wise free stream fluid in the vicinity of the downstream portion of the peak of the upper and lower surface. The deceleration of the free stream fluid causes a local increase in the static pressure in the troughs of the channel between adjacent fins. The momentum of the length-wise fluid stream is not sufficient in the boundary layer near the surfaces of the fins to overcome the higher pressure in the troughs, thus separation of the boundary layer occurs.

Further, the undulating shape of the channel between adjacent wavy fins gives rise to a positive pressure gradient with respect to the flow direction in the direction of convex to concave surfaces at any point along the flow channel due to centrifugal effects. Thus, the prior art wavy plate fin heat exchanger has a higher pressure at the troughs, while it has a lower pressure at the peaks.

Figure 4:
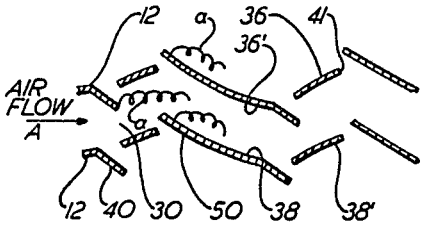
FIG. 4 is a cross-sectional view of the fin of FIG. 3 taken along lines 4—4.
Figure 5:
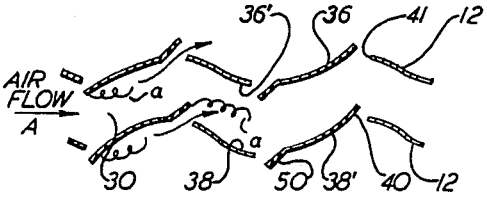
FIG. 5 is a cross-sectional view of the fin of FIG. 3 taken along lines 5—5.

Referring now to FIGS. 4 and 5, there is illustrated a side elevational view of a preferred embodiment of the present invention. There is shown a plurality of spaced-apart fins 12 with tubes (not shown) received through respective axial aligned holes. The wavy plate fins 12 have a sine-wave like pattern in cross section along the length-wise direction of fluid flowing over the upper surface 32 and lower surface 34. A plurality of ramp wings 40 and delta wings 50 are punched, or the like, through the plate fins 12 downstream of the peaks 36 and 36' of the upper and lower surfaces of the plate fins respectively.

In FIGS. 4 and 5, arrow A indicates the direction of fluid flow, such as air flow, over and between fin plates 12. As the fluid flows between fins 12 in channels 30, the pressure difference between the upstream and downstream surfaces of the ramp wing 40 and delta wing 50 causes a pair of counter rotating vortices (a). A path followed by the fluid off the ramp wings 40 virtually eliminates recirculation fluid in the troughs, and delays or eliminates separation downstream of the peaks, while mixing the bulk fluid in the channel 30. A path followed by the fluid off the delta wings 50 generally stay near the surface of the fin to scrub the boundary layer next to the fin. A pair of vortices is generated by the ramp wings 40 and delta wings 50 to energize the stalled boundary layer downstream of the wings and achieve bulk mixing and boundary layer scrubbing.

While a preferred embodiment of the present invention has been depicted and described, it will be appreciated by those skilled in the art that many modifications, substitutions, and changes may be made thereto without departing from the true spirit and scope of the invention.

What is claimed is:

1. An enhanced plate fin of a plate fin heat exchanger for transferring heat between the fin and a fluid flowing over the fin comprising:

a convoluted heat transfer means for enhancing the exchange of heat between the fluid and the fin, said convoluted heat transfer means having a sine-like wave pattern of predetermined height along the fin in a direction parallel the flow of the fluid over the fin, said sine-like wave pattern having curved peaks at a maximum and minimum of said wave heights of the pattern along the fin, said peaks extend along said convoluted heat transfer means generally transverse to the direction of flow of the fluid flowing over the fin; and an enhanced heat transfer section disposed generally parallel to said peaks, said enhanced heat transfer section having a number of rows of a plurality of raised delta wing means and ramp means, said rows of raised delta wing means and ramp means arranged in a direction generally perpendicular to the direction of flow of the fluid, a side length of each of said plurality of raised delta wing means and ramp means connected to the fin in a direction generally perpendicular to the direction of flow of the fluid, said side length of said ramp means positioned upstream in the flow direction of the fluid wherein said raised ramp means form counter rotating vortices in the fluid and said side length of said delta wing means positioned downstream in the flow direction of the fluid, said raised delta wing means and ramp means are triangular shaped, with a raised apex downstream in the fluid direction from said side length connected to the fin for said raised ramp means, and with a apex upstream in the fluid direction from said side length connected to the fin for said raised delta wing means.

2. A plate fin as set forth in claim 1 wherein each row of a plurality of raised delta wing means and ramp means has a raised delta wing means adjacent each ramp wing means.

3. A plate fin as set forth in claim 2 wherein said rows of raised delta wing means and ramp means are generally located at or proximately downstream, in the flow direction of the fluid, of said peaks of the first and second surfaces.

4. A plate fin as set forth in claim 2 wherein adjacent rows of said raised delta wing means and said ramp means are raised alternately upwardly and downwardly.

* * * * *